US007806146B2

(12) United States Patent
Borer

(10) Patent No.: US 7,806,146 B2
(45) Date of Patent: Oct. 5, 2010

(54) DEVICE FOR CONTROLLING THE TRANSVERSE MOVEMENT OF THE WARP THREADS OF A TEXTILE WEAVING MACHINE

(75) Inventor: Silvan Borer, Frick (CH)

(73) Assignee: Textilma AG, Standsstad (CH)

( * ) Notice: Subject to any disclaimer, the term of this patent is extended or adjusted under 35 U.S.C. 154(b) by 0 days.

(21) Appl. No.: 12/449,758

(22) PCT Filed: Nov. 12, 2007

(86) PCT No.: PCT/CH2007/000559

§ 371 (c)(1),
(2), (4) Date: Aug. 25, 2009

(87) PCT Pub. No.: WO2008/116325

PCT Pub. Date: Oct. 2, 2008

(65) Prior Publication Data

US 2010/0037979 A1 Feb. 18, 2010

(30) Foreign Application Priority Data

Mar. 27, 2007 (CH) ..... 0490/07

(51) Int. Cl.
*D03C 3/20* (2006.01)
*D03C 3/32* (2006.01)
*D03C 5/06* (2006.01)

(52) U.S. Cl. ..... 139/55.1; 139/59; 139/60; 139/65; 139/80; 139/90

(58) Field of Classification Search ..... 139/35, 139/55.1, 59–65, 79, 80, 82, 85, 87–90, 455
See application file for complete search history.

(56) References Cited

U.S. PATENT DOCUMENTS 3,867,966 A * 2/1975 Wieland ..... 139/455
4,041,733 A * 8/1977 Brada et al. ..... 66/138

(Continued)

FOREIGN PATENT DOCUMENTS

DE 2151580 A1 10/1971

(Continued)

*Primary Examiner*—Bobby H Muromoto, Jr.
(74) *Attorney, Agent, or Firm*—George Pappas

(57) ABSTRACT

In order to solve the problem of not having enough space available for a large number of components and keeping the deflection of the electric motor small in a device for controlling the transverse movement of the warp threads of a textile weaving machine, particularly a textile weaving machine with single strand movements, the invention proposes to operatively connect the strands via power transmission elements having different lengths in a staggered or register-like way to an electric motor and to provide the electric motors with a ratio in relation to the strands such that the movement of the electric motors brings about a greater movement of the strands.

20 Claims, 6 Drawing Sheets

U.S. PATENT DOCUMENTS

| | | | | | |
|---|---|---|---|---|---|
| 4,460,020 | A | * | 7/1984 | Juillard | 139/82 |
| 4,541,458 | A | * | 9/1985 | Reiter | 139/55.1 |
| 4,614,212 | A | * | 9/1986 | Olenwine | 139/79 |
| 4,687,029 | A | * | 8/1987 | Takada | 139/84 |
| 4,998,420 | A | * | 3/1991 | Scavino | 66/138 |
| 5,070,913 | A | * | 12/1991 | Palmer | 139/319 |
| 5,794,665 | A | * | 8/1998 | Keim | 139/455 |
| 6,006,795 | A | * | 12/1999 | Corain et al. | 139/453 |
| 6,079,455 | A | * | 6/2000 | Speich et al. | 139/455 |
| 6,189,576 | B1 | * | 2/2001 | Markward | 139/54 |
| 6,230,760 | B1 | * | 5/2001 | Di Natale et al. | 139/453 |
| 6,293,315 | B1 | * | 9/2001 | Froment et al. | 139/55.1 |
| 7,493,920 | B2 | * | 2/2009 | Vanderjeugt | 139/55.1 |
| 2004/0261882 | A1 | | 12/2004 | Dagois et al. | |
| 2005/0204834 | A1 | * | 9/2005 | Speich et al. | 74/25 |
| 2006/0169345 | A1 | * | 8/2006 | Speich | 139/55.1 |

FOREIGN PATENT DOCUMENTS

| | | | |
|---|---|---|---|
| DE | 31 30 461 | A1 | 7/1981 |
| DE | 19849728 | A1 | 10/1998 |
| EP | 0304985 | A1 | 3/1989 |
| EP | 0 347 626 | A2 | 12/1989 |
| EP | 0 353 005 | A1 | 1/1990 |
| EP | 1 063 326 | A1 | 12/2000 |
| EP | 1 493 857 | A1 | 1/2005 |
| WO | WO 95/11327 | | 4/1995 |
| WO | WO 98/24955 | | 6/1998 |
| WO | WO 2006/063584 | A2 | 6/2006 |

* cited by examiner

DEVICE FOR CONTROLLING THE TRANSVERSE MOVEMENT OF THE WARP THREADS OF A TEXTILE WEAVING MACHINE

This application claims priority of PCT application PCT/CH2007/000559 having a priority date of Mar. 27, 2007, the disclosure of which is incorporated herein by reference.

TECHNICAL FIELD

The invention relates to a device for controlling the transverse movement of the warp threads of a textile weaving machine, in particular of a textile weaving machine having individual heddle movement.

BACKGROUND OF THE INVENTION

Devices for controlling the transverse movement of the warp threads of textile weaving machines, in particular of weaving machines having individual heddle movement, are basically known from numerous documents. In many of these publications, attempts are made to put forward suitable proposals so that the problematic weaving harness of a shedding device of a Jacquard machine can be dispensed with.

EP 0 353 005 A1 discloses a drive arrangement for controlling the transverse movement of the warp threads, in which, with a linear motor, a closed drive cord for the heddles which is guided via four rotating rollers is proposed. However, the implementation of the invention disclosed in EP 0 353 005 A1 comes up against difficulties which are based, on the one hand, on the fact that, with a relatively large number of warp threads arranged next to one another, sufficient space could not be made available for a large number of linear motors, but also for the deflecting rollers, and, on the other hand, on the fact that the deflection of the linear motors proposed there was, in a justifiable version, too small for the necessary transverse movements of the warp threads.

It is known from WO-A-98/24955 to tension-mount the driving part of a weaving machine—in this case, a heddle or a heddle shaft—between two spring parts and to provide an electric drive which raises or lowers the driving part, together with the warp threads, for shedding purposes. This invention also discloses the proposal to design the above-described arrangement as a free oscillator such that a large part of the kinetic energy from the elastic spring force is applied, while the electric drive is intended rather as compensation for the energy losses and to activate the corresponding device. However, the version with the two springs in WO-A-98/24955 likewise takes up a relatively large amount of space, as may also be gathered from the drawings there. Furthermore, it seems difficult, in the arrangement proposed in WO-A-98/24955, on the one hand, to keep the build of the electric motor small, but, on the other hand, to design it with such high power and high movement that it fulfills the requirements when a multiplicity of warp threads lying next to one another are to undergo shedding.

Further publications, such as, for example, WO-A-/11327 or WO-A-2006/114188, are likewise concerned with a free oscillator arrangement, but without being able to solve the problems mentioned above.

EP 1 063 326 A1 discloses cord drives for the heddles of a textile weaving machine having individual heddle movement, and it is proposed there to wind the cords on one side onto electromotively driven cord rollers and to keep them tensioned on the other side by means of a helical spring fastened to the loom. However, the principles of a free oscillator, which are already known from the document mentioned above, are not implemented by means of the device from EP 1 063 326 A1.

Finally, WO-A-2006/063584 discloses a shedding device with individual thread control, in which, in a basically known way, a lifting spring frame or a fixed spring frame with a retaining element for the individual heddles is proposed. However, this type of shedding has proved to be susceptible to faults, since the retaining elements mentioned are basically temperamental.

EP 0 347 626 A2 and DE 198 49 728 A1 disclose electromotive drives for the shedding of weaving machines, which have a coil and a sheet-like permanent magnet, by means of which a rotational movement is proposed for shedding. In this case, a lever action (step-up) is proposed in EP 0 347 626 A2.

SUMMARY OF THE INVENTION

The object of the invention is to improve a device for controlling the transverse movement of the warp threads of a textile weaving machine, in particular of a textile weaving machine having individual heddle movement.

In this case, the measures of the invention result, in the first place, in a very low space requirement, along with a high weaving speed. Due to the register-like fanning out of the heddle drives and to the spring assistance, it is possible to keep the electric drive motors small. Moreover, owing to the lever-like intensification, it becomes possible for the drive travel of these motors to be kept small.

It is advantageous if one at least double step-up is provided, that is to say a movement of the electric motors causes an at least twice as great a movement of the heddles.

A refinement with pull and push rods as force transmission elements for the drive of the driving elements, which may be generally conventional heddles, but, in a special case, also guide eyes, which are attached directly to the pull and push rods, affords, a simple embodiment of the invention.

An advantageous embodiment is proposed with a drive of the heddles by cords as force transmission elements which are connected to the electric motors, the fan-like or register-like arrangement being made possible by means of deflecting rollers or, in a further advantageous refinement, by means of deflecting levers with a stroke step-up. The deflecting rollers or deflecting levers in this case deflect the cords preferably through 60° to 120°, most preferably through 75° to 105°, in order to provide as much space as possible for register-like fanning out. If two springs are used in this case, for example, one of the springs may be arranged on the side of the heddles which lies opposite the deflecting rollers or deflecting levers and be designed as a conventional tension spring.

The kinetic energy of the heddles may be made available predominantly by springs. The springs are in this case set up such that they make available in a first end position and in a second end position in each case high potential energy as force which drives the heddles in the direction of the other end position. In one position, in a solution with a spiral compression spring, the spring force disappears. In a solution with a compression spring and tension spring or a solution with two opposite tension springs, the potential energies of the two springs cancel one another. During movement, therefore, in a position which is advantageously the middle position, the heddles have a maximum speed. The heddles are then moved further on into the other end position in each case, the springs then being capable of absorbing the kinetic energy of the heddles in the form of potential energy. In order to allow controlled movement and selective dwelling in the first or the second end position, for the first end position and for the second end position in each case holding means are provided which stop the movement and hold the respective heddle in the end position assumed. In order to allow controlled movement, then, a selectively switchable electric motor is additionally provided. This, together with the spring force, overcomes the holding force of the holding means and can thus free the heddle from its holding position. Basically, therefore, the motor is intended for releasing the holding means and for initiating the movement action. Furthermore, the motor serves for compensating energy losses and for adapting the device to changing operating conditions. The device is controlled by means of the control of the motor.

It is advantageous if at least 75% of the kinetic energy is extracted from the spring or springs and the electric motor applies at most 25% of the kinetic energy. Furthermore, it is advantageous if the holding means are designed, uncontrolled, as permanent magnets which cooperate with magnetic stays, the ends of the step-up lever serving as magnetic stays. Advantageously, in a third shed position between the upper shed and the lower shed position, no force is exerted on the heddles. In a symmetrical arrangement, this is a middle shed position.

The abovementioned elements to be used according to the invention, and also those claimed and those described in the following exemplary embodiments, are not subject to any special exceptional conditions in terms of their size, shape, use of material and technical design, and therefore the selection criteria known in the respective field of use can be adopted unrestrictively.

In particular, the invention is not restricted to a textile weaving machine having individual heddle movement. On the contrary, the invention may also be used for a weaving machine in which heddles are combined, for example by means of heddle shafts, etc.

BRIEF DESCRIPTION OF THE DRAWINGS

Exemplary embodiments of a device for textile machines, in particular a textile weaving machine having individual heddle movement, are described in more detail below with reference to the drawings in which.

DETAILED DESCRIPTION OF THE PREFERRED EMBODIMENTS

Figure 1:
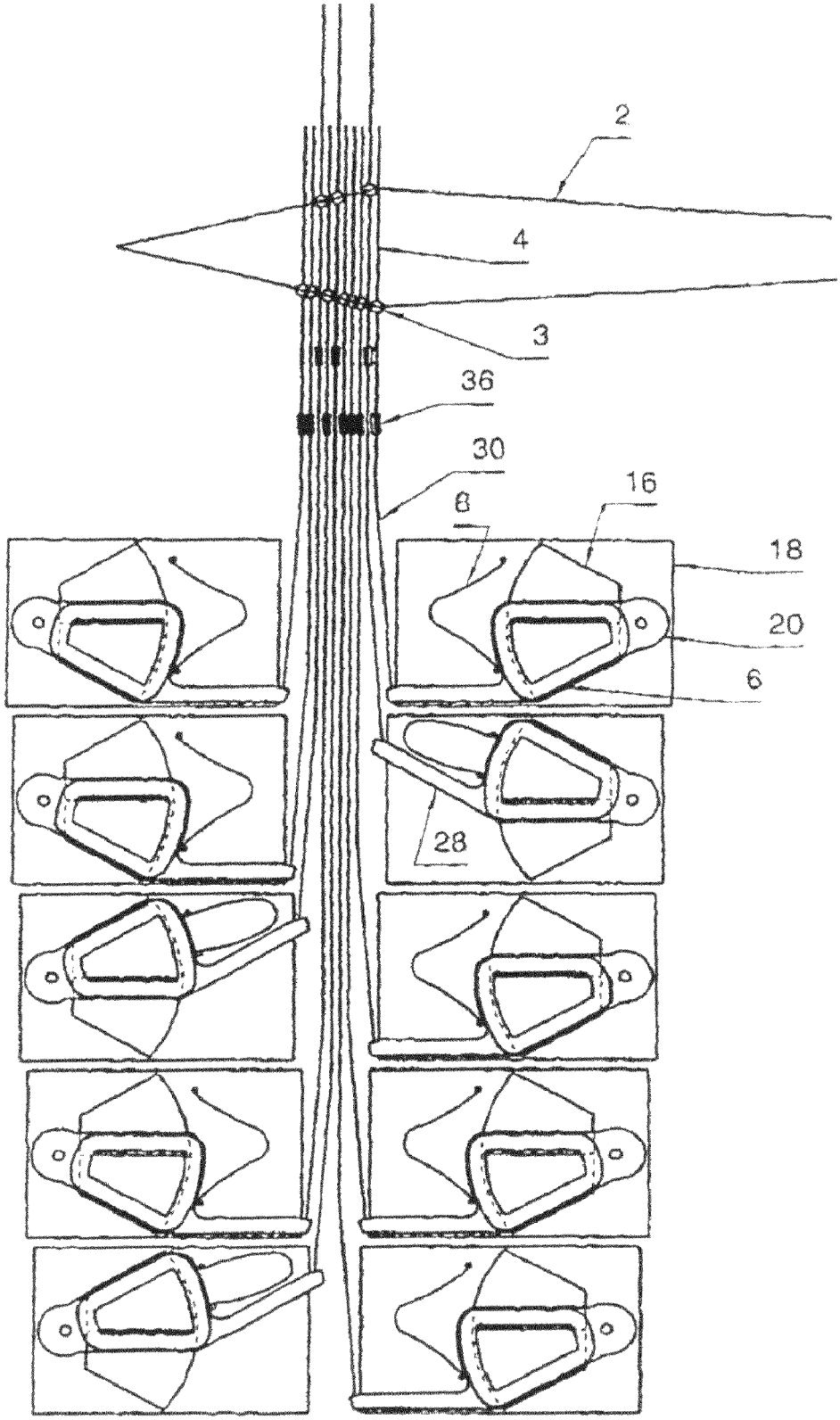
FIG. 1 shows a heddle drive according to a first exemplary embodiment of the invention with pull and push rods, accumulator spring and torque motor.
Figure 2:
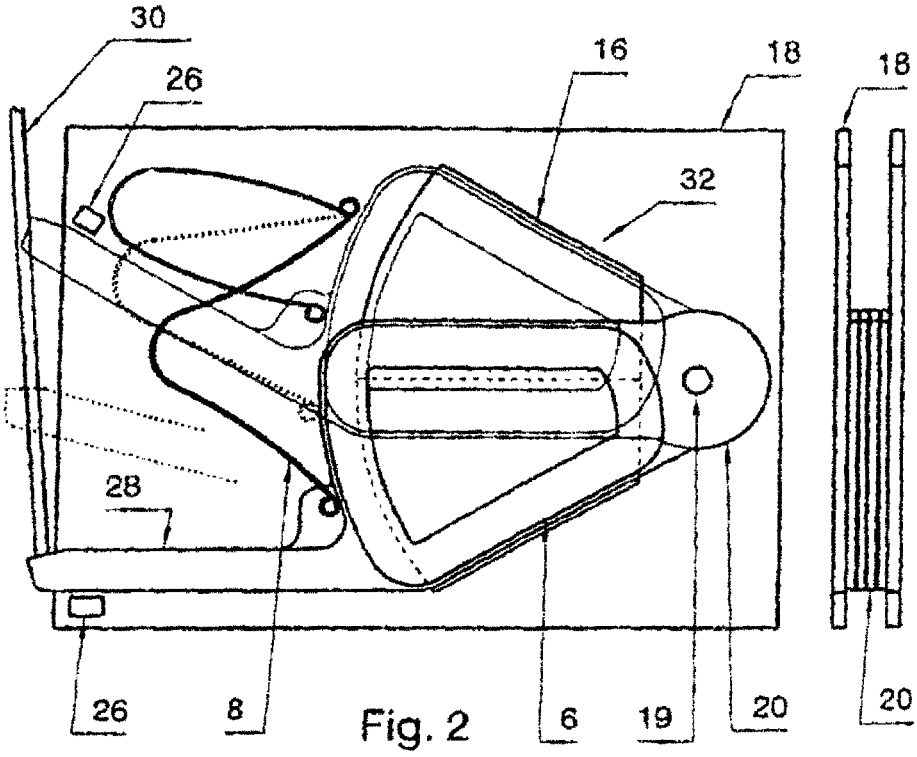
FIG. 2 shows an illustration of the torque motor according to FIG. 1 as a detail.
Figure 3:
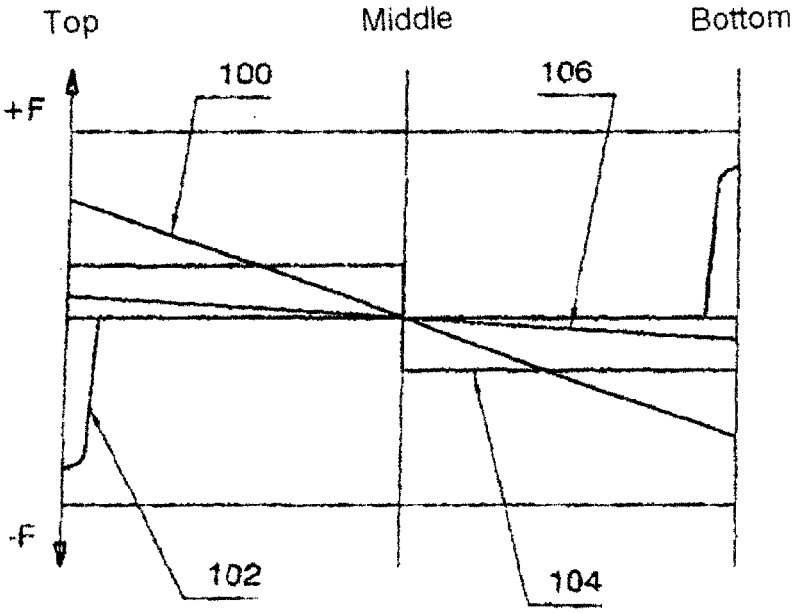
FIG. 3 shows a force graph for the movement sequences of the warp threads.

A first exemplary embodiment for carrying out the present invention is illustrated in FIGS. 1 and 2.

FIG. 1 shows a device for driving the heddles 4, designed as driving parts of the warp threads 2, of a textile weaving machine having individual heddle movement, in a side view. The warp threads 2 are moved by means of the heddles 4 having thread eyes 3, such that, as illustrated in the exemplary embodiment, they are located either in an upper shed position or in a lower shed position. The heddles 4 are arranged by means of couplings 36 on push and pull rods 30 which in each case have a length different from that of the adjacent rod. The drive elements for the heddles 4 can thereby be arranged in a staggered or register-like manner. The staggered or register-like arrangement is provided here in duplicate form, in such a way that the left half of the heddles 4 is assigned to a left register of electric motors 32 and the elements assigned to these, while the right half of the heddles 4 is assigned to a right register of electric motors 32, virtually in a mirror-symmetrical arrangement, and the elements assigned to these. The ends of the push and pull rods 30 are in each case fastened to an operative lever 28 which is operatively connected to an electric motor 32 designed as a pivoting motor. Each electric motor 32 has a coil 6 which is fastened to a coil carrier 20 pivotable about an axis 19. The coil former, in turn, is arranged between two base plates 18. Each electric motor 32 has, furthermore, a permanent-magnetic plate 16. Thus, by means of the polarity of a current flowing through the respective coil, the coils assume one of two end positions which are marked in the drawing. These two positions correspond to the two positions "upper shed" or "lower shed" of the heddles 4 and consequently the shedding of the warp threads 2.

However, the position of the abovementioned elements is not free, but is prestressed by a spiral tension and compression spring 8 such that, in the two end positions "upper shed" and "lower shed", a spring force directed away from the stops takes effect, while in a middle position of the coils 6, no spring force takes effect. Two stop magnets 26 are arranged such that they form holding means for the two end positions "upper shed" and "lower shed".

The graph 3 shows the force conditions of the elements described above. In this case, the spring force graph 100 shows that the spring force of the spiral tension and compression spring 8 is symmetrical about the middle position, in which it disappears, and is linear. During a raising or lowering movement of the heddles 4, the largest fraction of energy is applied by the spring drive of the spiral tension and compression spring 8. However, the movement is initiated by an electric motor 32. As long as the electric motor 32 is not in operation, the corresponding heddle 4 is retained by the upper or the lower stop magnet 26 in the upper or lower end position, which correspond to the upper shed position or the lower shed position of the warp threads of a shed. This is achieved in that the stop magnets 26 designed as permanent magnets have a higher holding force 102 than the restoring force of the spiral tension and compression spring 8 during deflection in the end positions. It should be pointed out that the holding force of the stop magnets 26 has a short range and is therefore relevant at all only in the vicinity of the levers 28 and therefore only in or in the vicinity of the respective end position.

In order, then, to set the heddles 4 in motion, that is to say to initiate a movement from the upper to the lower end position or from the lower to the upper end position, the corresponding coils 6 are supplied with voltage and the electric motors 32 is thus put into operation. The sum of the active forces 104 of the electric motor and of the spring force 100 of the spiral tension and compression spring 8 in a deflective state, that is to say in one of the end positions, is greater than the holding force 102 of the corresponding stop magnets 26.

If, then, the holding force of the stop magnets 26 is overcome, the movement of the heddle via the corresponding push and pull rod 30 is brought about predominantly by the spring force of the spiral tension and compression spring 8, the electric motor 32 cooperating in this movement, without appreciably contributing to it. When the other end position is reached, that is to say, for example, the lever 28 comes into the active range of the lower stop magnet 26, the new end position is reached and the spiral tension and compression spring 8 remains deflected, since, in this position, the force of the permanent magnet 26 is higher than the restoring force of the spiral tension and compression spring 8 and the electric motor 32 does not assist the latter.

In the exemplary embodiment shown here, the spiral tension and compression spring 8 is operated in the linear range, so that the spring force graph 100 can be represented by a straight line. The spring force is assisted only insignificantly by the warp thread force 106, and therefore the warp thread force 106 plays no part here. The stop magnet graph 102 clearly shows the short range of the magnetic forces which act only when the levers 28 are in the immediate vicinity of the stop magnets 26 and an end position is assumed. The coil force graph 104 of the electric motor 32 has, in the operating mode described here, a constant force which may point in one direction or the other, depending on polarity.

In the exemplary embodiment described here, the electric motor 32 is designed such that, in addition to the upper position and the lower position, a middle position of the heddle 4 can be assumed and the heddle 4 can be moved out of this middle position into the upper position or into the lower position. The purpose of this operating mode is that a position of rest can be assumed in which the spiral tension and compression spring 8 exerts no force on the push and pull rod 30 and the corresponding heddle 4. The heddle 4 is controlled solely by means of the electric motor 32 which, for this purpose, is connected to a control unit of a weaving machine in a way not illustrated in any more detail.

Figure 4:
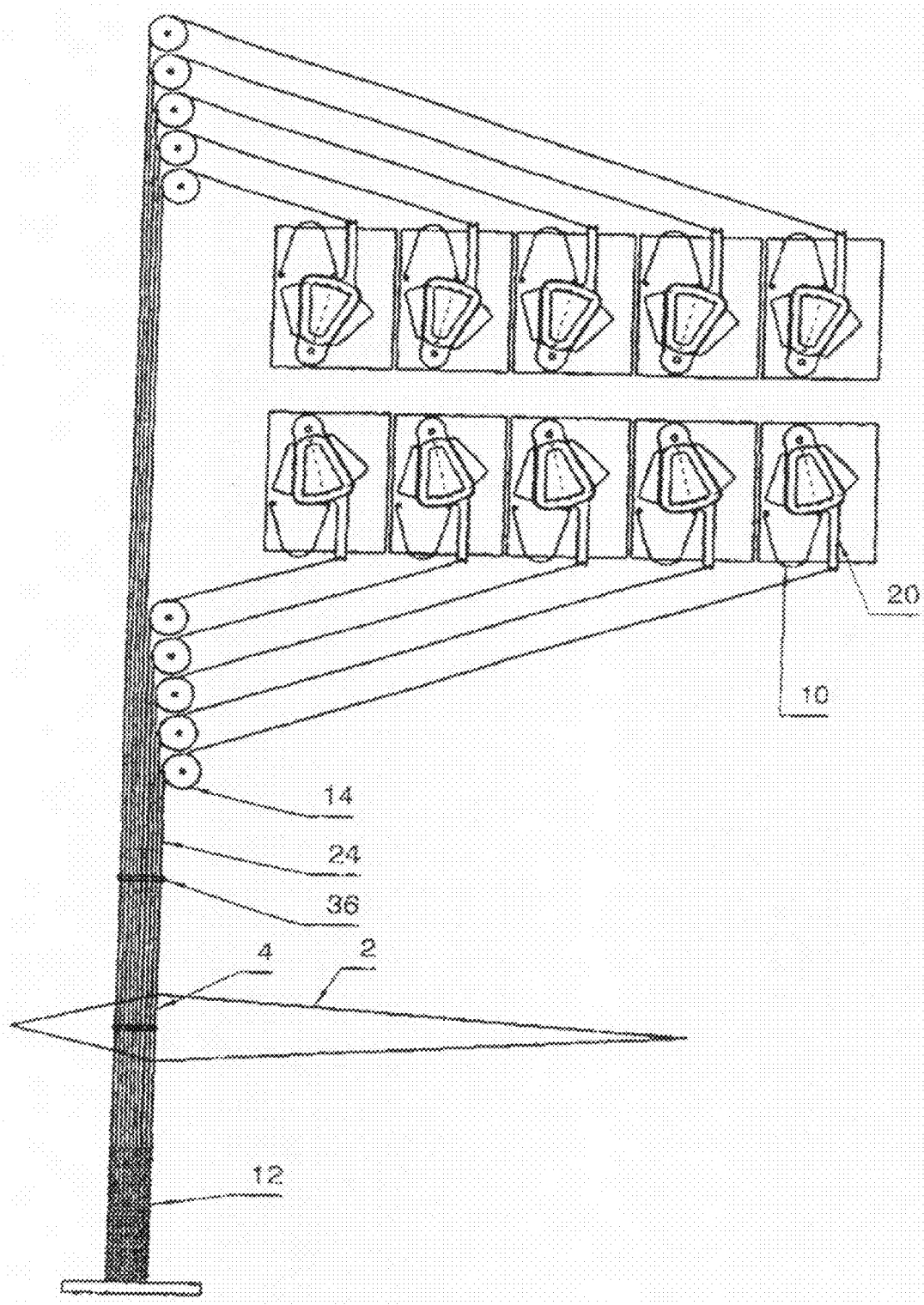
FIG. 4 shows a heddle drive according to a second exemplary embodiment of the invention with tension spring, spiral spring, cord elements and torque motor.
Figure 5:
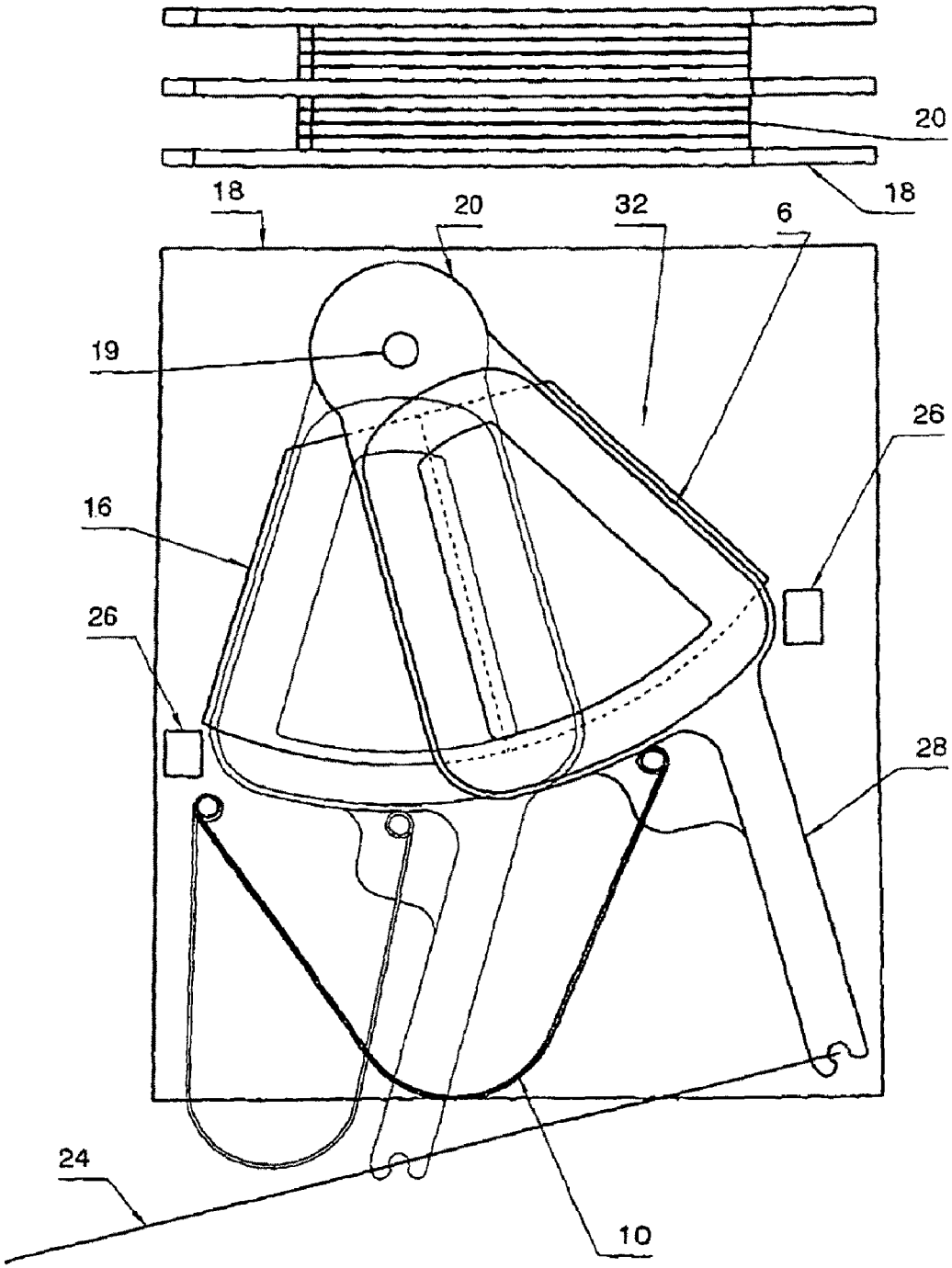
FIG. 5 shows an illustration of the torque motor according to FIG. 1 as a detail.

FIG. 4 and FIG. 5 illustrate a device for driving the heddles of a textile weaving machine having individual heddle movement, in a side view, according to a second exemplary embodiment.

In this exemplary embodiment, wire cords 24 serve as pull elements. The wire cords 24 are connected to the heddles 4 in a conventional way, for example by means of couplings, and in each case have a length different from that of the adjacent cord. As a result, the drive elements can, in turn, be arranged in a staggered or register-like manner. Here, too, the staggered or register-like arrangement is provided in duplicate form in such a way that the left half of the wires cords 4 is assigned to an upper register of electric motors 32 likewise designed as a pivoting motor and the elements assigned to these, while the right half of the wire cords 24 is assigned to a lower register of electric motors 32 and the elements assigned to these. The ends of the wire cords 24 are in this case likewise fastened to an operative lever 28 which is operatively connected to an electric motor 32. The electric motor has basically the same set-up as in the first exemplary embodiment.

In this exemplary embodiment, the heddles 4 are prestressed, on the side facing away from the electric motor, in the lower shed position in each case by means of a tension spring 12. In this exemplary embodiment, the spring force counter to the tension spring 12 is brought about by spiral springs 10 which are arranged on the electric motor 32. In this case, the forces of the tension spring 12 and of the spiral spring 10 cancel one another in a middle position of the coils 6. Two stop magnets 26 are arranged, in turn, such that they form holding means for the two end positions "upper shed" and "lower shed". The conditions are otherwise identical to or correspond to the first exemplary embodiment.

Figure 6:
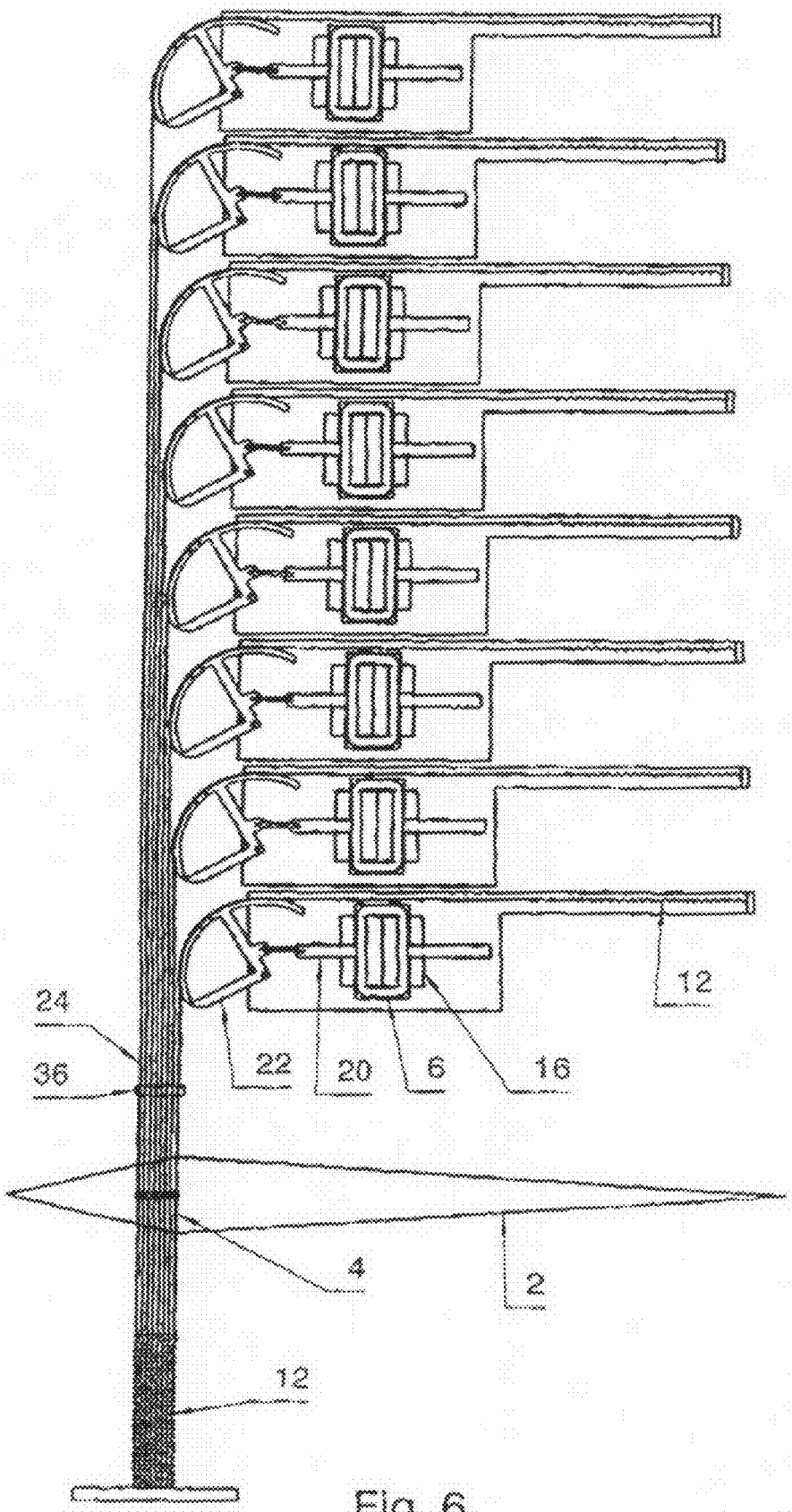
FIG. 6 shows a heddle drive according to a third exemplary embodiment of the invention with tension springs, cord elements and linear motor.
Figure 7:
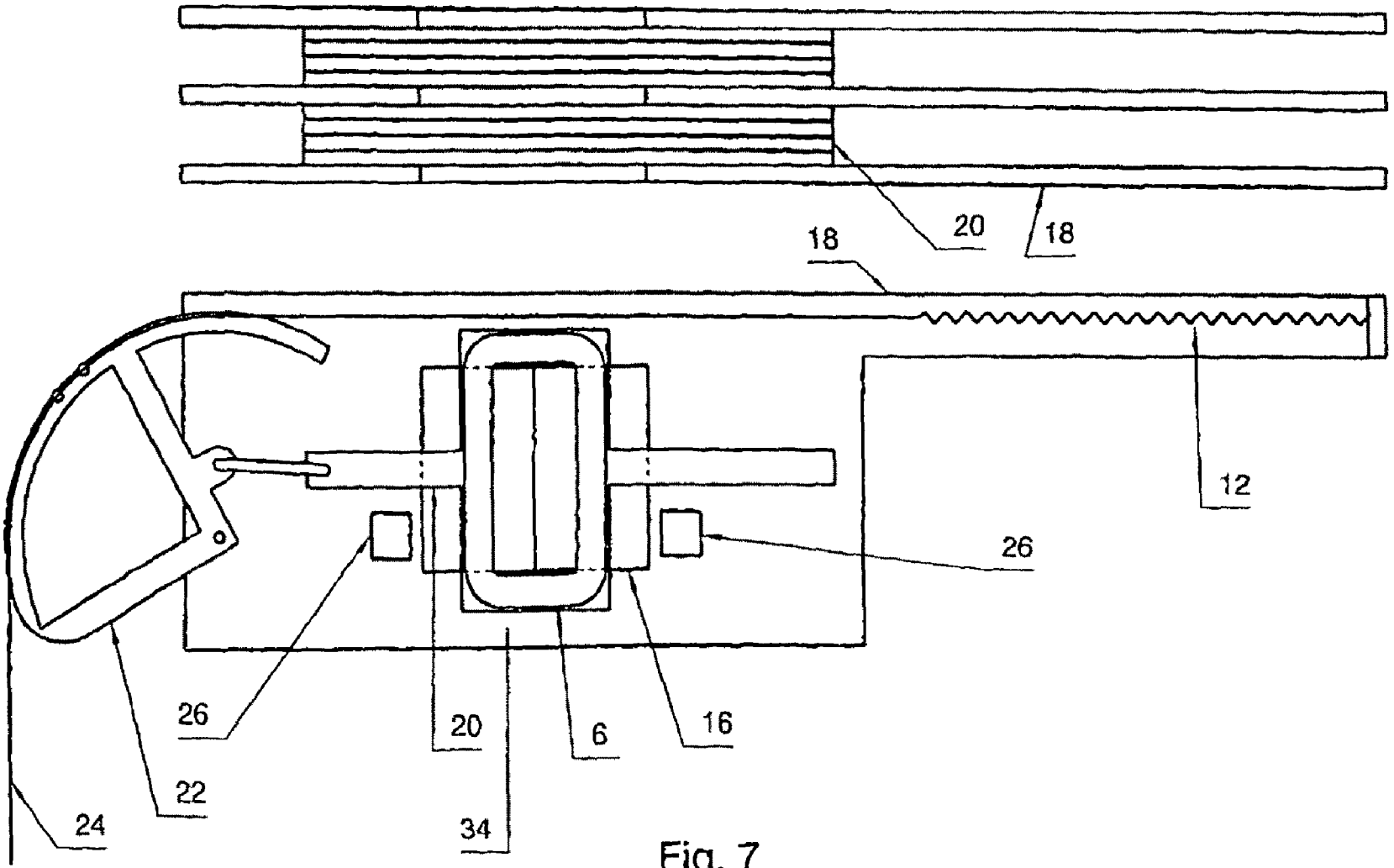
FIG. 7 shows an illustration of the linear motor of FIG. 6 as a detail.

FIG. 6 and FIG. 7 illustrate a device for driving the heddles of a textile weaving machine having individual heddle movement, in a side view, according to a third exemplary embodiment.

In this exemplary embodiment, the wire cords 24 likewise serve as pull elements for the heddles. The wire cords 24 again have in each case a length which is different from that of the adjacent cord. As a result, the drive elements can again be arranged in a staggered or register-like manner. Here, too, however, the staggered or register-like arrangement is provided in a simple way.

The ends of the wire cords 24 are fastened about an axis to a pivotable operative lever 22 which is operatively connected to an electric motor 34.

The difference from the second exemplary embodiment is here, in particular, that the cord deflection is not formed by deflecting rollers, but by an operative lever 22 which is pivotable about the axis and which is coupled by means of a to the electric motor 34. The electric motor 34 is designed here as a linear motor. In this exemplary embodiment, the wire cords 24 are prestressed by two tension springs 12 such that in each case the spring force of a tension spring 12 takes effect in the two end positions "upper shed" and "lower shed". In this case, the forces of the tension springs 12 cancel one another in a middle position of the coils 6 of the electric motor 34. Two stop magnets 26 are again arranged such that they form holding means for the two end positions "upper shed" and "lower shed". The conditions are otherwise identical to or correspond to the first exemplary embodiment.

It should be emphasized for clarity that, in the description of the invention and particularly in the description of the preferred exemplary embodiments, a distinction was made between the heddles 4 and the force transmission elements 24 and 30. However, the push and pressure rods 30 may also be continuous and therefore also form the heddles. Furthermore, the cords 24 may also have eyes for leading through the warp threads and consequently at the same time form the heddles.

LIST OF REFERENCE SYMBOLS

2 Warp threads
3 Thread eye
4 Heddles with thread eye
6 Coil
8 Spiral tension and compression spring
10 Spiral compression spring
12 Tension spring
14 Deflecting roller
16 Permanent-magnetic plate
18 Base plate
19 Axis
20 Coil carrier
22 Cord deflection with reduction to linear drive
24 Wire cord, pull element
26 Stop magnets
28 Lever
30 Push and pull rods
32 Electric motor, torque motor
34 Electric motor, linear motor
36 Coupling
100 Spring force graph
102 Stop magnet graph
104 Coil force graph
106 Warp thread graph

The invention claimed is:

1. A device for controlling the transverse movement of the warp threads of a textile weaving machine, in particular of a textile weaving machine having individual heddle movement, with a multiplicity of driving parts for warp threads, which serve for driving the warp threads and which in each case comprise a spring drive spring means and holding means, the holding force of the holding means being opposite to the drive force of the spring drive and being capable of holding the driving parts in an upper shed position and in a lower shed position counter to the spring force, the driving parts, further, being operatively connected via force transmission elements in each case to an electric motor as a result of the activation of which a shed control by the driving parts can be initiated, and the action of the holding means being capable of being overcome by the sum of the forces of the spring drive and of the electric motor, characterized in that the driving parts are operatively connected in each case to an electric motor in a staggered or register-like manner via force transmission elements of different length, and in that the electric motors have, as compared with the driving parts, a step-up such that a movement of the electric motors causes a greater movement in the driving parts.

2. The device as claimed in claim 1, characterized in that a movement of the electric motors causes an at least twice as great a movement of the driving parts.

3. The device as claimed in claim 1, characterized in that the driving parts are operatively connected as heddles with pull and push rods to an electric motor by means of a step-up lever arranged on the latter.

4. The device as claimed in claim 1, characterized in that the driving parts are operatively connected to an electric motor via drive cords, and in each case deflecting rollers are arranged between the driving parts and the electric motors together with spring elements of the spring drive.

5. The device as claimed in claim 1, characterized in that the driving parts are operatively connected to an electric motor via drive cords, and in each case deflecting levers with a stroke step-up are arranged between the driving parts and the electric motors together with spring elements of the spring drive.

6. The device as claimed in claim 4, characterized in that the deflecting rollers or the deflecting levers with stroke step-up deflect the drive cords through 60° to 120°, preferably through 75° to 105°.

7. The device as claimed in claim 4, characterized in that the driving parts for the warp threads are arranged on one side on fixedly arranged spring means of the spring drives, which are opposite to the electric motors and the deflecting rollers or the deflecting levers with stroke step-up.

8. The device as claimed in claim 1, characterized in that the spring drives are designed such that, when the driving parts are operating at the characteristic frequency of the spring drive, the greater part of the kinetic energy can be obtained from the spring drive.

9. The device as claimed in claim 8, characterized in that the spring drives are designed such that, when the driving parts are operating at the characteristic frequency of the spring drive, at least 75% of the kinetic energy can be obtained from the spring drive.

10. The device as claimed in claim 1, characterized in that the holding means are designed as uncontrolled holding means with stop magnets, the stop magnets being designed as permanent magnets.

11. The device as claimed in claim 10, characterized in that the lever ends for the step-up comprise magnetic stays for the holding means.

12. The device as claimed in claim 1, characterized in that, in a third shed position of the driving parts between the upper shed position and the lower shed position, no force is exerted on the driving parts.

13. The device as claimed in claim 12, characterized in that the third shed position forms a middle shed position of the driving parts.

14. The device as claimed in claim 2, characterized in that the driving parts are operatively connected as heddles with pull and push rods to an electric motor by means of a step-up lever arranged on the latter.

15. The device as claimed in claim 2, characterized in that the driving parts are operatively connected to an electric motor via drive cords, and in each case deflecting rollers are arranged between the driving parts and the electric motors together with spring elements of the spring drive.

16. The device as claimed in claim 2, characterized in that the driving parts are operatively connected to an electric motor via drive cords, and in each case deflecting levers with a stroke step-up are arranged between the driving parts and the electric motors together with spring elements of the spring drive.

17. The device as claimed in claim 5, characterized in that the deflecting rollers or the deflecting levers with stroke step-up deflect the drive cords through 60° to 120°, preferably through 75° to 105°.

18. The device as claimed in claim 5, characterized in that the driving parts for the warp threads are arranged on one side on fixedly arranged spring means of the spring drives, which are opposite to the electric motors and the deflecting rollers or the deflecting levers with stroke step-up.

19. The device as claimed in claim 6, characterized in that the driving parts for the warp threads are arranged on one side on fixedly arranged spring means of the spring drives, which are opposite to the electric motors and the deflecting rollers or the deflecting levers with stroke step-up.

20. The device as claimed in claim 2, characterized in that the spring drives are designed such that, when the driving parts are operating at the characteristic frequency of the spring drive, the greater part of the kinetic energy can be obtained from the spring drive.

* * * * *